US005839511A

United States Patent [19]

Williams

[11] Patent Number: 5,839,511

[45] Date of Patent: Nov. 24, 1998

[54] BLOWOUT PREVENTER WASH-OUT TOOL

[76] Inventor: Donald L. Williams, 202 Holstein La., Youngsville, La. 70592

[21] Appl. No.: 870,208

[22] Filed: Jun. 6, 1997

[51] Int. Cl.[6] ..... E21B 37/00

[52] U.S. Cl. ..... 166/312; 166/223

[58] Field of Search ..... 166/312, 222, 166/223, 311

[56] References Cited

U.S. PATENT DOCUMENTS

| | | | |
|---|---|---|---|
| 1,866,927 | 7/1932 | Ekstromer | 166/222 |
| 2,338,372 | 1/1944 | Wright | 166/312 |
| 3,116,800 | 1/1964 | Kammerer | 166/222 |
| 3,827,492 | 8/1974 | Hammon et al. . | |
| 3,908,771 | 9/1975 | Garrett . | |
| 4,349,073 | 9/1982 | Zublin | 166/312 |
| 4,442,899 | 4/1984 | Zublin | 166/312 |
| 4,603,739 | 8/1986 | Krugh . | |
| 4,612,986 | 9/1986 | Fosdick, Jr. et al. | 166/171 |
| 5,195,585 | 3/1993 | Clemens et al. | 166/222 |
| 5,419,397 | 5/1995 | Reynolds et al. . | |

*Primary Examiner*—Frank Tsay
*Attorney, Agent, or Firm*—Robert N. Montgomery

[57] ABSTRACT

A tool for washing out drill cuttings accumulations in blowout preventer stacks connected to oil and gas well prior to testing the blowout preventers. The tool utilizes a finned tubular member and a brush to break away and fluidicly scour drill cuttings and the like from the well head casing connection and the blowout preventers and riser casing connected thereto with high pressure fluids emitted from the tool being directed into the crevices of the preventers, thereby flushing cuttings accumulations upwardly, through the riser casing to the surface for removal, prior to pressurizing the well head and testing of the system by actuating the ram type blowout preventers.

8 Claims, 3 Drawing Sheets

BLOWOUT PREVENTER WASH-OUT TOOL

BACKGROUND OF THE INVENTION

1. Field of the Invention

The present invention relates to a process for clearing cuttings debris in an oil and gas well drilling operation and more particularly to the clearing of cuttings from a subsea blowout preventer stack prior to testing of the shear ram blowout preventers.

2. General Background

Drilling operations, especially offshore, require, the drilling rig to be located a significant distance above the point where the drill bit makes contact with the earth. In such cases templates are anchored to the earth at the mud line and a casing head is attached to the template. Blowout preventers are then attached to the casing head and a string of flanged casings called risers are then attached to the Blowout preventers and ultimately attached to the drilling rig. The drill string and bit, driven by the drilling rig, is then passed through the risers and the blowout preventers and into the earth. A fluid passed through the center of the drill string for lubricating the drill bit flushes well cuttings to the surface through the annulus between the drill string and the casing. Since the length of the riser string could be extensive, in some cases over 4000 feet, and the drill bit is always smaller than the annulus of the blowout preventers, decreasing progressively in size as the well is drilled, the cuttings being flushed to the surface tend to decrease in velocity at each deviation casing size. Therefore, the annulus around the drill string in the riser casing and blowout preventers, especially at each point of casing or hole size deviation, is always filled with cuttings.

Industry safety requirements stipulate that blowout preventers be tested at least once each week. Therefore, in most cases, removal of the drill string from the drilled hole and the risers is necessary so that the shear ram blowout preventers can be closed and the well pressurized to full working pressure. When the drill string is removed from the well, drill cuttings remain in the annulus between the drill string and the casing. Cuttings tend to cascade down the risers and accumulate in the blowout preventer stack and well head. The cuttings tend to block the blowout preventers and interfere with closure testing. Attempts to flush the cuttings from the blowout preventers have not proven effective. The cuttings further interfere with reentry of the drill string through the blowout preventers.

Various tools for cleaning debris from a well bore generally operate on the principle of brush and vacuum , such as that described by U.S. Pat. Nos. 3,827,492, 4,603,739, and 5,419,397. The disclosed tools are designed to scrape and vacuum loose material from the walls of the well casing and have no means of removing or dislodging material which is not in direct contact with the tool. In fact, such tools simply dislodge the material or contain a portion of the material within the tool. In such cases the tool must be removed and cleaned or the bore flushed with the tool in place, thereby recreating the problem of cuttings accumulation when the tool string is removed.

Tools used for scouring the casing walls, such as that disclosed in U.S. Pat. No. 5,419,397, have no high pressure nozzles and are not intended or useful for operation in the riser column or inside the blowout preventers.

Jetting or drilling tools employing nozzles, such as that disclosed by U.S. Pat. No. 3,908,771, simply provides a flushing action via nozzles but do not provide sufficient fluid velocity from the nozzles due to the central core feeding the nozzles also being open to the to the drill bit. Further, such jetting tools are intended for use in the earth bore hole and therefore must pass through the casing head and thus are ineffective in washing out the blowout preventer at point of connection with the casing head. Therefore, there is a need for a tool to rotatably dislodge well drill cuttings which accumulate at strategic points in the blowout preventer stack and flush them to the surface, thereby removing obstacles which may interfere with closure of the shear ram blowout preventers and thereby clearing the path for return of the drill string.

SUMMARY OF THE INVENTION

The present invention is a drill string sub tool composed of a heavy wall drill collar having a pin end and box end, the central portion of which is somewhat larger in diameter than its end portions and has a thicker wall section. The drill collar is centrally fitted with three fins extending outwardly from the body of the drill collar, the outer diameter of the fins being slightly smaller than the inside diameter of the Blowout preventers and riser casing in which the tool is to be used. The drill collar is further fitted with several threaded nozzle connections, adjacent each fin, communicative with the collar's central fluid path. Nozzles having a variety of patterns may be employed. The nozzles, being located behind the fins, thereby trailing the fins when the collar is rotated in a clockwise direction, hydraulically scour the crevices which are not in contact with the fins. Upwardly directed nozzles located below the fins are also provided which tend to force any loose materials upwards. The pin end of the collar is fitted with a nose cap that may also be fitted with a pair of jet nozzles for removing any cuttings in the tool's path. The cap forces the high pressure fluids out of the nozzles at a very high velocity.

A scouring brush tool may also be incorporated in the string adjacent the wash-out tool described above. The brush is also fitted with upward directed nozzles located below the brush assembly. The combination thereby being used to dislodge and flush drill cuttings accumulations located at or near the blowout preventer stack and riser casing.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
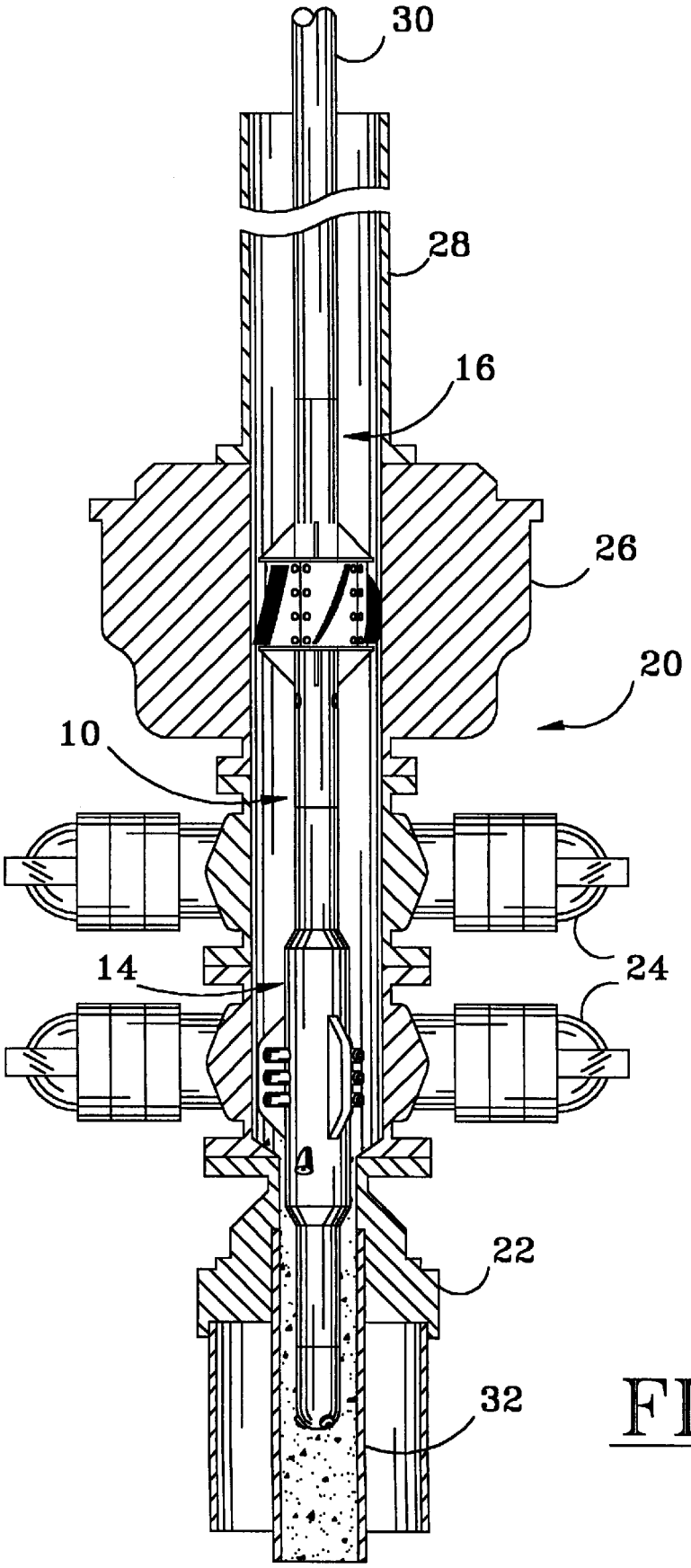
FIG. 1 is a cross section view of the clean out tool inserted in a well head and blowout preventer stack.
Figure 2:
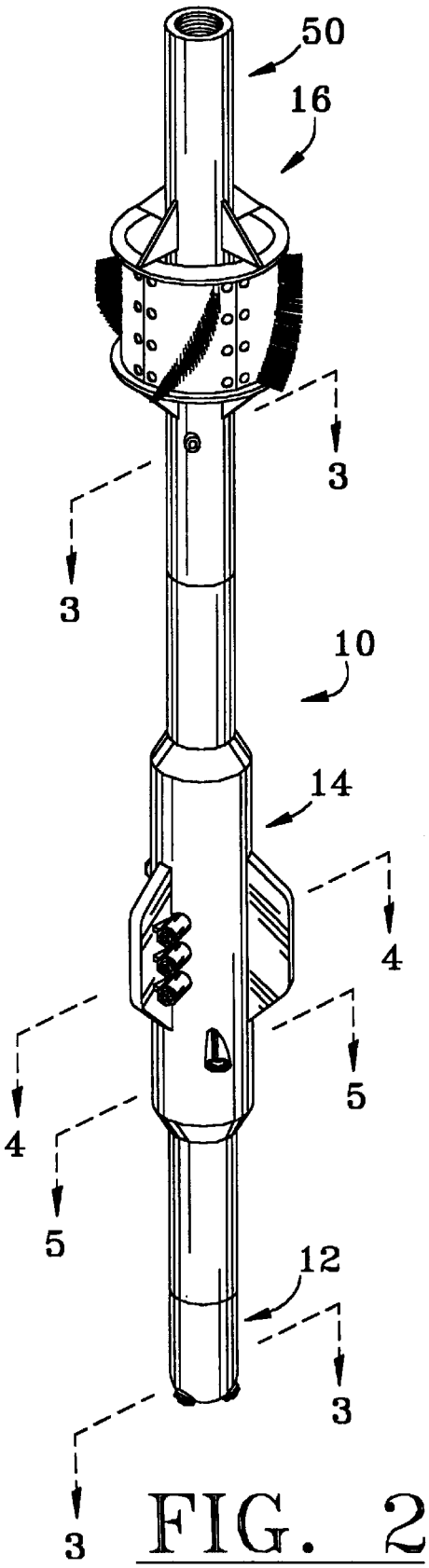
FIG. 2 is an isometric view of the combination washout and scrub brush tool assembly.

As best seen in FIG. 2 the blowout preventer stack cleaning tool assembly 10 consists of three principle elements, the lower nozzle or cap portion 12, the finned collar portion 14, and the brush portion 16. The tool assembly 10 is shown inside the blowout preventer stack 20 in FIG. 1. The preventer stack, connected to well head 22, consists of a series of shear ram type blowout preventers 24 and an annular blowout preventer 26. Riser casings are shown connected to the annular blowout preventer that extend to the surface and subsequently connect to a drilling platform or drilling vessel (not shown). The tool 10 is connected to a rotatable drill string 30 . The tool's cap portion 12, seen in FIG. 2 may extend into the well head casing 32 for a short distance. However, the tool's finned collar portion 14 is not allowed to pass the well head 22 connection with the shear ram blowout preventers 24. The brush portion 16 located above the finned collar portion 14 wipes the riser walls and serves as a stabilizer for the wash out tool 10.

Figure 5:
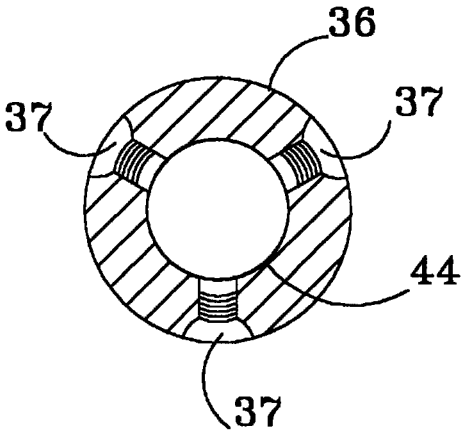
FIG. 5 is a cross section view taken along sight line 5—5 in FIG. 2

The cap portion 12 seen in FIG. 2 is closed at one end and internally bored and threaded to mate with a cooperatively threaded fitting at the lower end of the finned collar portion 14. The cap 12 is further bored and threaded as seen in FIG. 2 and 5 at oblique angles located at the closed end for receiving threaded nozzles 11 which may have a variety of spray patterns. The nozzles 11 are directed downwardly away from the closed end.

Figure 3:
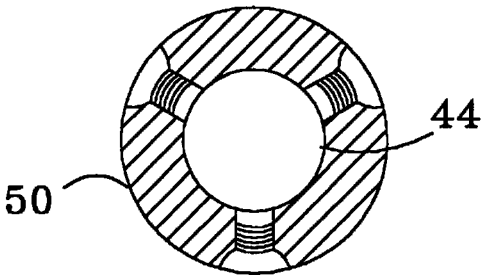
FIG. 3 is a cross section view taken along sight lines 3—3 in FIG. 2.
Figure 4:
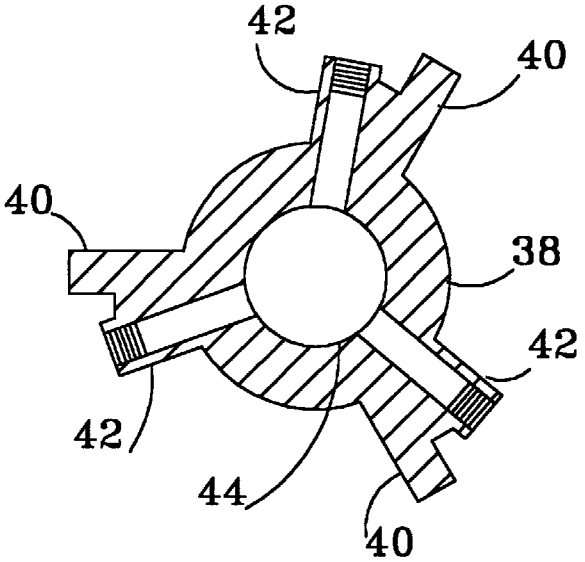
FIG. 4 is a cross section view taken along sight line 4—4 in FIG. 2.
Figure 6:
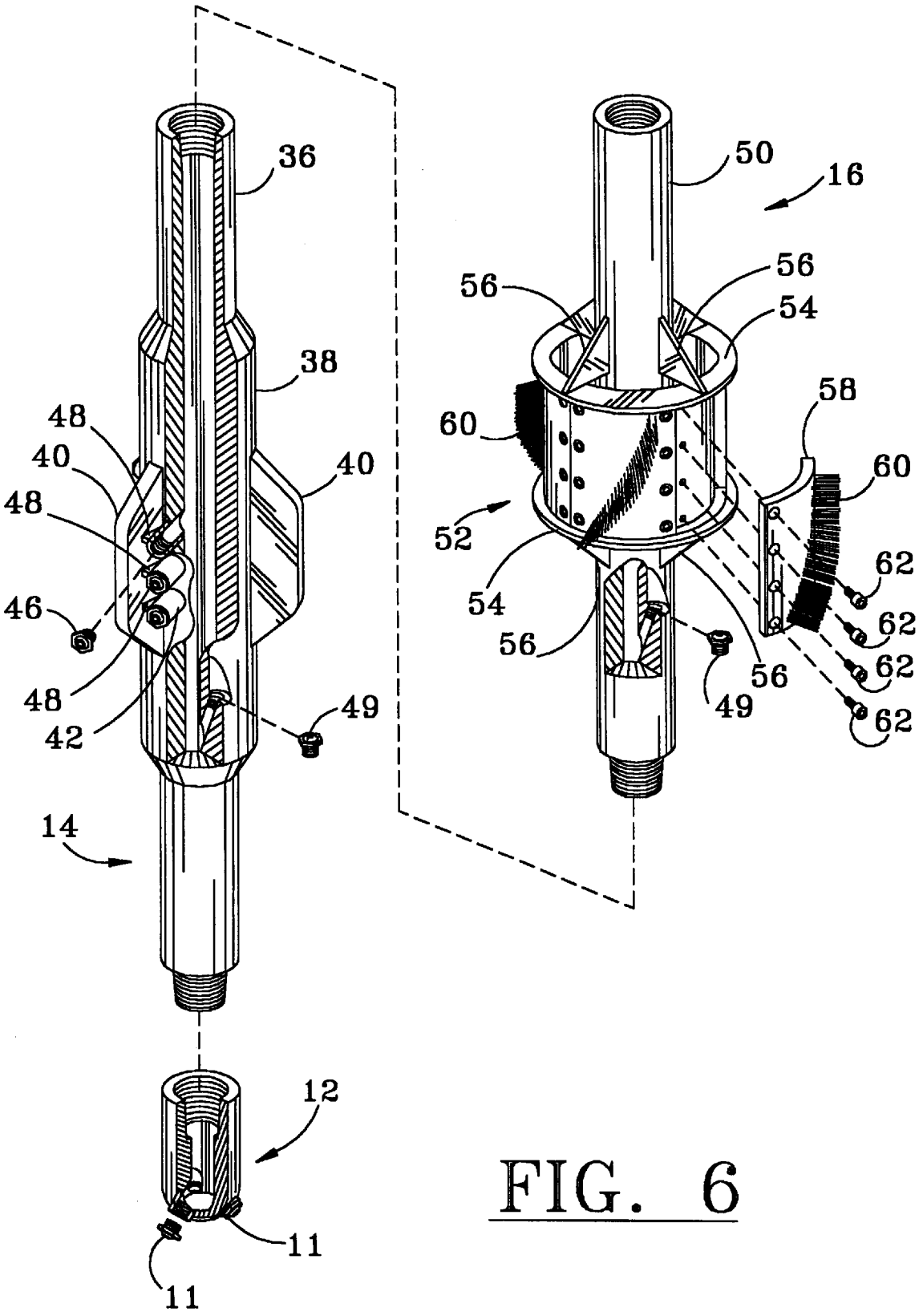
FIG. 6 is an illustration, partial cross section and exploded view of the washout and brush tool combination.

The tool joint or finned drill collar portion 14 includes an internally bored tube or tubular drill string sub joint 36 as seen in cross section in FIG. 3–5 and in partial section shown in FIG. 6. The bored tube or sub joint 36 includes a double wall thickness section 38 making up the intermediate portion of the sub 36 for externally securing fins 40 as seen in FIG. 6 and in cross section FIG. 4, the heavy section fins 40 being spaced symmetrically around the exterior surface of the heavy wall tube section 38. The bored tube 36 is threadably configured at each end for mating with other elements in a drill pipe string and more particularly with the brush portion 16 and cap portion 12 of the tool 10. The heavy wall tube section 38 is further bored adjacent each fin 40 to accept three nozzle tubes 42, the bores of which are in communication with the central bore 44 of the finned collar portion tube 36,38. The nozzle tubes 42 spaced linearly along the heavy wall section 38 and to the left of each fin 40 as viewed in FIG. 4 thereby lagging the fin 40 when the finned collar portion 14 rotates clockwise. The nozzle tubes 42 taped at their exposed ends for threadably accepting high pressure nozzles 46 may also have a variety of spray patterns. The nozzles 46 located parallel to the fins 40 are directed outwardly. A gusset or web 48 shown in FIG. 6 and seen in Cross section in FIG. 4, further supports the nozzle tubes 42. The brush portion 16 of the tool 10 also seen in FIG. 6 consists of a bored tubular drill collar sub joint 50 having a brush assembly 52 located midway along the subsection's length. The sub 50 is threaded at each end for threadably mating with other elements comprising a drill pipe string. The brush assembly 52 includes an upper and lower disk 54 attached and reinforced with gussets 56 attached to the exterior surface of sub 50 and a system of removable panels 58 having bristles 60 attached thereto, the panels secured to the upper and lower disk by screws 62. The tubular drill collar or subsection 50 bored as seen in FIG. 3 interconnects or otherwise communicates with the longitudinal central bore 44 to threadably receive the three nozzles 49 shown in FIG. 6 equally spaced around the subsection 50 directed upwards toward the brush assembly 52. The bristles 60 may be heavy wire or plasticized material and may have any number of bristle patterns or arrangements.

When the tool 10 is used to wash out drill cuttings, which tend to accumulate in the well head 22, the blowout preventer stack 20 and the riser column 28, the tool is inserted in the riser column via a drill string. The drill string is then rotated, while a fluid is forced into the central core of the tool via the drill pipe, under pressure, and while the tool is being lowered through the riser casing towards the well head. The tool 10, having a capped 12 longitudinal through bore 44, forces the fluid through the nozzles 11, 46, 49, thereby breaking up and otherwise dislodging accumulated solids from the blowout preventer stack 20, the well head 22 and riser column 28. The upwards direction of the nozzles 46.49 located below the fins 40 and below the brush assembly 16 forces the solids to move upwards through annulus of the riser column 28 to the surface where they are removed. The downward directed nozzles 11 on the closed portion of the end cap 12 displace and wash away any solids that may prevent sealing apparatus from effectively sealing the well head casing 32 so that the well can be sealed and the blowout preventer stack 20 can be pressurized, thereby allowing the ram type blowout preventers 24 to be closed when the wash out tool 10 is removed.

The brush assembly 16 scours the walls of the blowout preventer stack and the riser column 28, thereby removing any obstructions interfering with testing of the blowout preventers or removal of the tool 10. Although the fins 40 of the tool 10 do not contact the inner surface of the riser column 28 or the blowout preventer stack 20, they are sized to remain in near proximity. Therefore, when rotated in a clockwise direction as viewed from above, the fins serve to breakup any solids that may have accumulated on the inner surfaces. The trailing high pressure nozzles 46 then scour away any remaining loose material from the crevices in and around the blowout preventers 24, 26.

Because many varying and different embodiments may be made within the scope of the inventive concept herein taught, and because many modification may be made in the embodiments herein detailed in accordance with the descriptive requirement of the law, it is to be understood that the details herein are to be interpreted as illustrative and not in any limiting sense.

What is claimed is:

1. A tool for washing out oil and gas well blowout preventer stacks comprising:

a) a first drill string sub joint;

b) a brush assembly attached to said drill string sub joint;

c) a second drill string sub joint threadably connected to said first drill string sub joint having fins and a plurality of nozzles; and d) an end cap threadably connected to said second drill string joint opposite said first sub joint.

2. A tool for washing out oil and gas well blowout preventer stacks according to claim 1 wherein said first drill string sub joint is an elongated drill collar having a longitudinal bore and an upper and lower threaded end, said collar being bored and counter bored to communicate with said longitudinal bore and to threadably receive a plurality of nozzles directed upwards towards said brush assembly.

3. A tool for washing out oil and gas well blowout preventer stacks according to claim 2 wherein said brush assembly comprises a plurality of interconnected removable panels having bristles extending outwardly therefrom.

4. A tool for washing out oil and gas well blowout preventer stacks according to claim 1 wherein said second drill string sub joint is an elongated drill collar having a longitudinal bore, upper and lower threaded ends and an extra heavy wall portion, located intermediate said ends, bored and counter bored to communicate with said longitudinal bore to threadably receive a portion of said plurality of nozzles directed upwards towards a plurality of said fins linearly attached and extending outwardly from said heavy wall portion, said extra heavy wall portion further comprising a plurality of tubes in communication with said longitudinal bore, located adjacent each of said fins and a portion of said plurality of nozzles threadably attached to said tubes directed outwardly from said drill collar.

5. A tool for washing out oil and gas well blowout preventer stacks according to claim 1 wherein said end cap comprises an internal longitudinal bore, an open threaded end and a closed conical end, said conical end being bored to communicate with said internal longitudinal bore and to threadably receive a plurality of nozzles directed obliquely downwards and away from said closed conical end.

6. An oil and gas well blowout preventer, wash out tool comprising:

a) a first drill collar sub section comprising:
- i) a longitudinal bore having upper and lower threaded ends;
- ii) a brush assembly located intermediate said upper and lower ends having a plurality of interconnected removable panels;
- iii) a plurality of bristles extending outwardly from said removable panels; and
- iv) a plurality of nozzles located below said brush assembly, directed upwards, threadably connected to bored passages communicating with said longitudinal bore;

b) a second drill collar subsection comprising:
- i) a longitudinal bore, upper and lower threaded ends and an extra heavy wall portion, located intermediate said ends;
- ii) a plurality of fins linearly attached and extending outwardly from said heavy wall portion;
- iii) a plurality of nozzles located below said fins, directed upwards towards said fins, threadeably connected to bored and counter bored passages in communication with said longitudinal bore;
- iv) a plurality of tubes in communication with said longitudinal bore, located adjacent each of said fins; and
- v) a plurality of nozzles threadably attached to said tubes and directed outwardly from said drill collar; and c) an end cap comprising an internal longitudinal bore, an open threaded end and a closed conical end, said conical end being bored to communicate with said internal longitudinal bore and to threadably receive a plurality of nozzles directed obliquely downwards and away from said closed conical end.

7. A method for washing out a blowout preventer stack comprising the steps of:

a) providing a drill string tool comprising:
- i) a tubular sub section combination including an end cap portion;
- ii) a means attached to said sub section for rotatably breaking and loosening solids accumulations; and
- iii) a means attached to said subsection combination for directing a fluid flowing through said tool under pressure;

b) attaching said tool to a rotatable drill string and inserting said tool in a casing leading to said blowout preventer stack;

c) pumping a fluid under pressure through said drill string and tool while rotating; and d) forcing said solids accumulations via said fluids upwards through said blowout preventers and casing.

8. A method for washing out blowout preventer stacks according to claim 7 wherein said second sub joint utilizes high pressure fluids directed from said plurality of nozzles to dislodge and scour loose solids from crevices in and around blowout preventers, and well head casing.

* * * * *